US008850931B1

(12) United States Patent
Hebert

(10) Patent No.: US 8,850,931 B1
(45) Date of Patent: Oct. 7, 2014

(54) OFFSET WRENCH WITH ADJUSTABLE HEAD

(76) Inventor: Leland J. Hebert, Castle Rock, CO (US)

( * ) Notice: Subject to any disclaimer, the term of this patent is extended or adjusted under 35 U.S.C. 154(b) by 266 days.

(21) Appl. No.: 13/424,425

(22) Filed: Mar. 20, 2012

(51) Int. Cl.
*B25B 13/14* (2006.01)
*B25B 13/12* (2006.01)

(52) U.S. Cl.
USPC ..... 81/166; 81/129

(58) Field of Classification Search
CPC ..... B25B 13/12; B25B 13/14; B25B 13/16; B25B 23/00; Y10S 81/08
USPC ..... 81/126, 129, 165–167
See application file for complete search history.

(56) References Cited

U.S. PATENT DOCUMENTS

| | | | | |
|---|---|---|---|---|
| 1,424,069 | A | 4/1921 | Blackmar | |
| 2,539,964 | A * | 1/1951 | Montgomery | 81/129 |
| 2,592,251 | A * | 4/1952 | Dayie | 81/6 |
| 2,791,143 | A * | 5/1957 | Rossi et al. | 81/165 |
| 2,895,364 | A | 7/1959 | Heinz | |
| 2,912,891 | A * | 11/1959 | Neff | 81/167 |
| 3,253,486 | A * | 5/1966 | Beck | 81/163 |
| 4,748,875 | A | 6/1988 | Lang | |
| D403,935 | S | 1/1999 | Jones | |
| 5,946,987 | A | 9/1999 | Wei | |
| 6,098,505 | A * | 8/2000 | Chang | 81/166 |
| 6,101,906 | A * | 8/2000 | Tai | 81/129 |
| D434,293 | S | 11/2000 | Chen | |
| D435,765 | S | 1/2001 | Owens et al. | |
| 6,167,786 | B1 * | 1/2001 | Kilgore | 81/142 |
| 6,481,317 | B1 * | 11/2002 | Reyes | 81/133 |
| 6,748,827 | B2 * | 6/2004 | Huang | 81/166 |
| 6,834,569 | B2 * | 12/2004 | Wang | 81/133 |
| 2010/0199814 | A1 * | 8/2010 | Lee et al. | 81/177.1 |

* cited by examiner

*Primary Examiner* — David B Thomas
(74) *Attorney, Agent, or Firm* — Montgomery Patent & Design; Robert C. Montgomery

(57) ABSTRACT

A universal offset wrench with a width-adjustable head for fire sprinkler systems includes an operating end having a width-adjustment mechanism used to expand and retract an adjustable jaw relative to a fixed jaw. The adjustable jaw accommodates sprinkler heads of various sizes and types. The offset operating end can be used with concealed sprinkler heads by allowing the wrench to fit under the sprinkler head while clearing ceiling obstructions.

18 Claims, 8 Drawing Sheets

OFFSET WRENCH WITH ADJUSTABLE HEAD

RELATED APPLICATIONS

Not Applicable.

FIELD OF THE INVENTION

The present invention relates generally to wrenches, and in particular, to an offset wrench with a width adjustable head for use with fire sprinklers.

BACKGROUND OF THE INVENTION

As anyone who performs a lot of mechanical work will attest, nothing beats having the proper tool for a job. The proper tool can save time and money, produces a higher quality job, reduces damage to equipment, and provides for the increased safety of the worker. Each field of mechanical work has its own type of specialty tools, each performing a specialized task. The field of fire sprinkler installation has many such specialized tools, but one important tool is still missing.

Overhead sprinkler heads attach to their respective piping systems by use of a threaded fitting and must be tightened or loosened with a wrench. One (1) problem with current tools is that the opening for the wrench is typically extremely narrow. Additionally, the sprinkler heads are often concealed within the ceiling or other structure which presents an even greater access problem.

Another problem is that each style and model of sprinkler head typically includes different sizes and diameters and needs a wrench or tool sized specifically for each type of sprinkler head. This requires the purchase of a new tool each time the sprinkler heads are replaced. Should a regular wrench be used, damage to the head, the piping system, or the surrounding ceiling is often the inevitable result.

While known sprinkler head tools exist, nothing addresses the aforementioned problems.

SUMMARY OF THE INVENTION

The inventor has recognized the aforementioned inherent problems and lack in the art and observed that there is a need for a means by which various work activities on sprinkler heads can be accomplished without the disadvantages as described above. The inventor has thus realized the advantages and benefits of providing an offset wrench with adjustable head.

Accordingly, it is an object of the present embodiments of the invention to address this need by developing an offset wrench with adjustable head that is simple to use in the removal and installation of fire sprinkler heads. Another object is to avoid the disadvantages of the known art by providing a single tool that is size-adjustable to fit sprinkler heads of different size, style, and type.

In accordance with the principles of the present invention, it is a feature of the invention to provide a device having a handle, a generally flat shank extending from the handle at a first offset angle relative to the handle, and a fixed jaw extending from the shank having a second offset angle relative to the shank.

Another feature of the invention is that the device includes an adjustable jaw moveably coupled to the shank. The adjustable jaw includes a generally flat base member and a jaw member extending from the base member at the second offset.

Another feature of the invention is that the device includes a smooth collar formed from a tubular member having smooth interior wall affixed to a back surface of the shank opposite the fixed jaw and a threaded collar formed from a tubular member having threaded interior wall affixed to a back surface the base member opposite the jaw member.

Another feature of the invention is that the device includes an adjustment recess disposed in the shank to accommodate the threaded collar.

Another feature of the invention is that the device includes an adjustment mechanism mechanically connected between the smooth collar and the threaded collar for adjusting a distance between the fixed jaw and the adjustable jaw.

Another aspect of the invention is to provide an adjustment mechanism having an actuator wheel, a smooth shaft extending from a first side of the wheel and attached to the smooth collar, and a threaded shaft extending from an opposing second side of the wheel and attached to the threaded collar. The threaded shaft threadingly mates with the threaded interior of the threaded collar such that rotation of the wheel adjusts a distance between the fixed jaw and the adjustable jaw.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
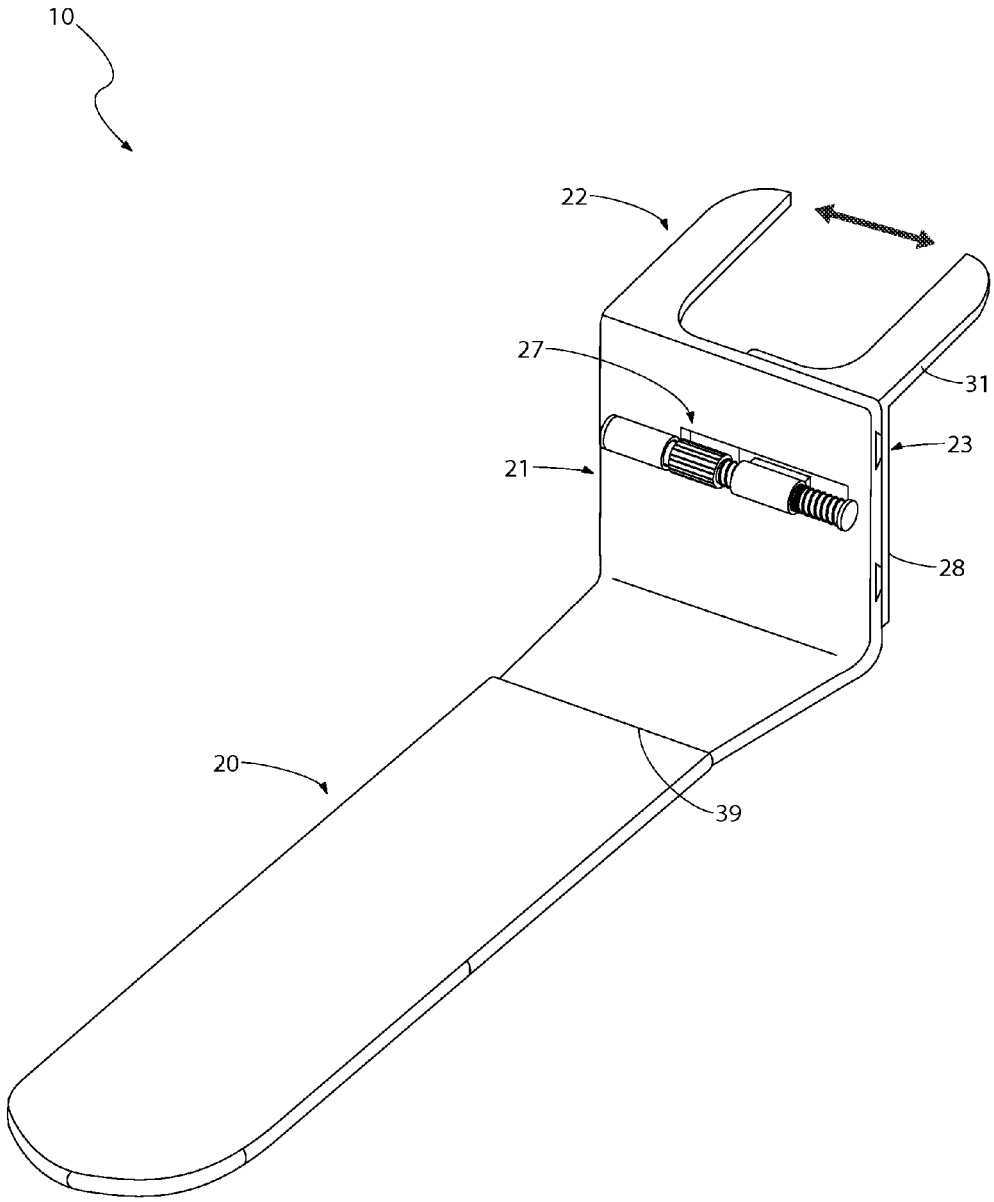
FIG. 1 is rear perspective view of an offset wrench with adjustable head in accordance with the present invention.

10 offset wrench with adjustable head
20 handle
21 shank
22 fixed jaw
23 adjustable jaw
24 first offset angle
25 adjustment recess
26 second offset angle

27 adjustment mechanism
28 base member
29 keeper feature
29*a* upper keeper feature
29*b* lower keeper feature
30 keeper channel
30*a* upper keeper channel
30*b* lower keeper channel
31 jaw member
32 smooth collar
33 wheel
34 smooth shaft
35 threaded shaft
37 open area
38 threaded collar
39 handle cover
40 cheater bar
41 handle end
42 bar handle cover
43 outer handle retainer
44 inner handle retainer
45 closed top surface
46 retainer end
47 standoff member
48 third offset angle

DETAILED DESCRIPTION OF THE PREFERRED EMBODIMENT

Figure 4:
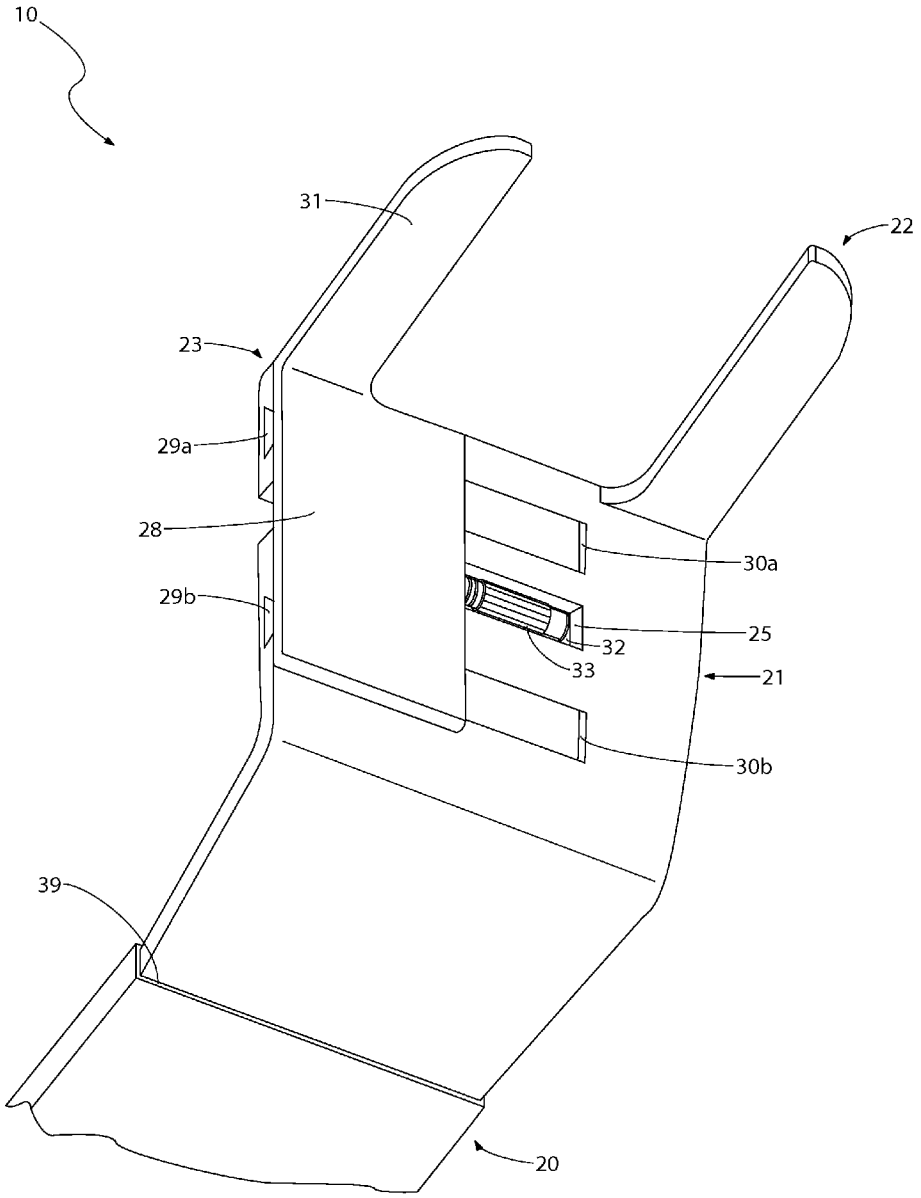
FIG. 4 is a partial front perspective view of the offset wrench with adjustable head.
Figure 5:
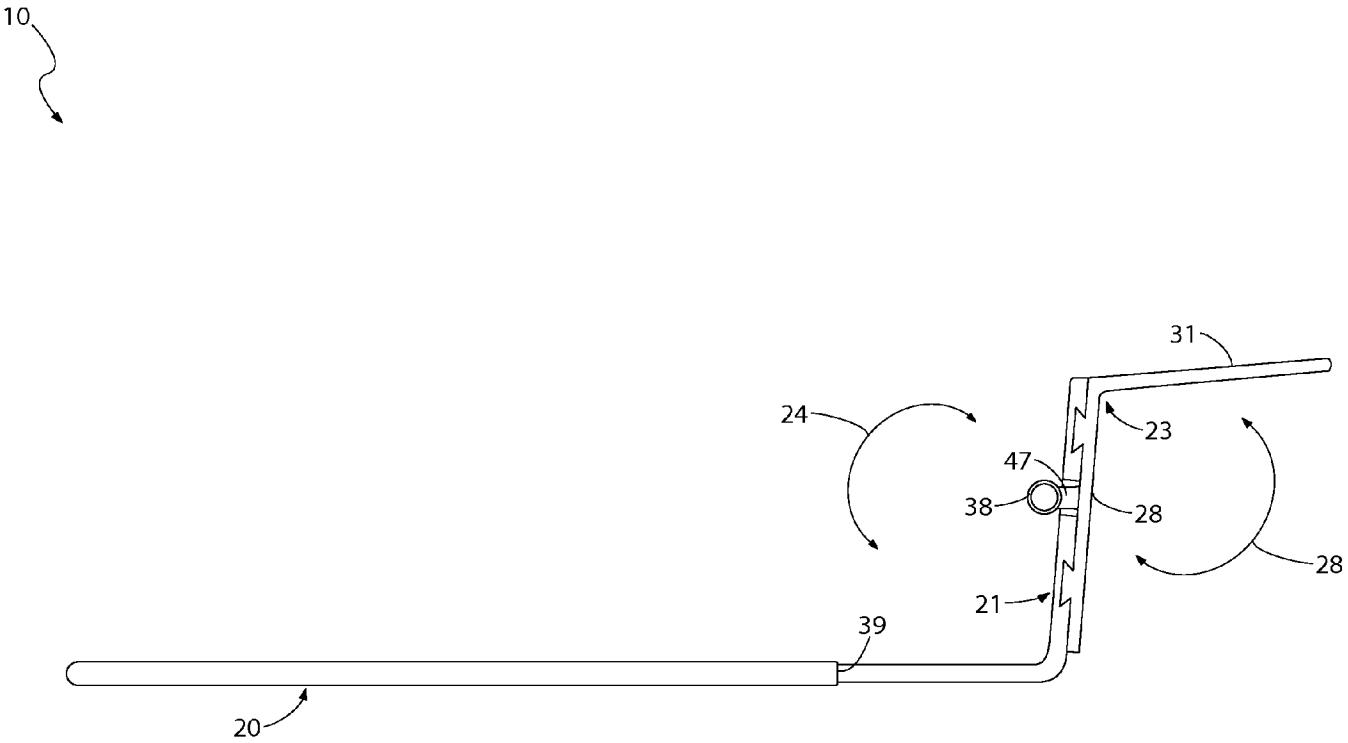
FIG. 5 is a side view of the offset wrench with adjustable head.
Figure 6:
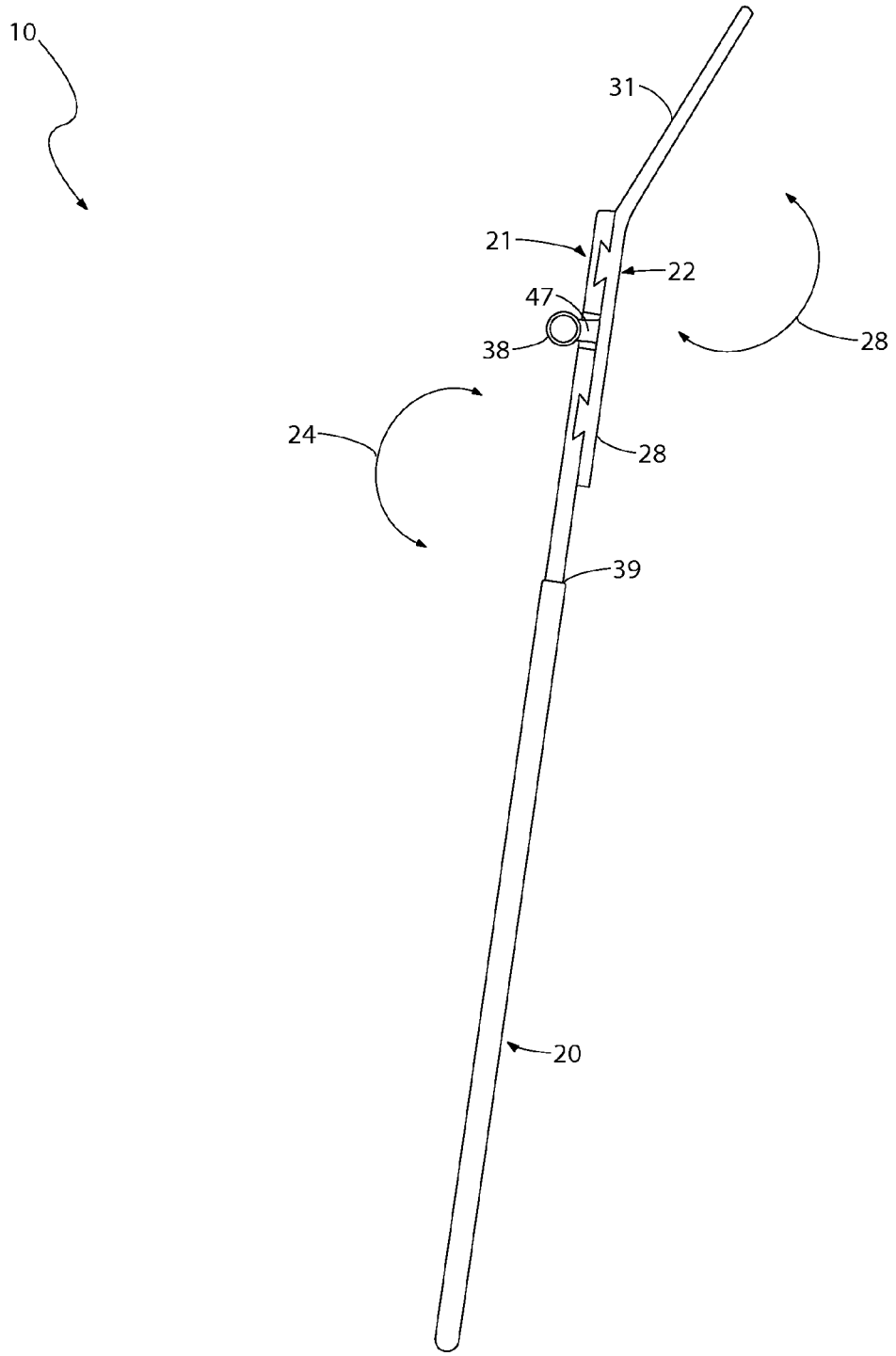
FIG. 6 is a side view of an alternate embodiment of the offset wrench with adjustable head in accordance with the present invention.
Figure 7:
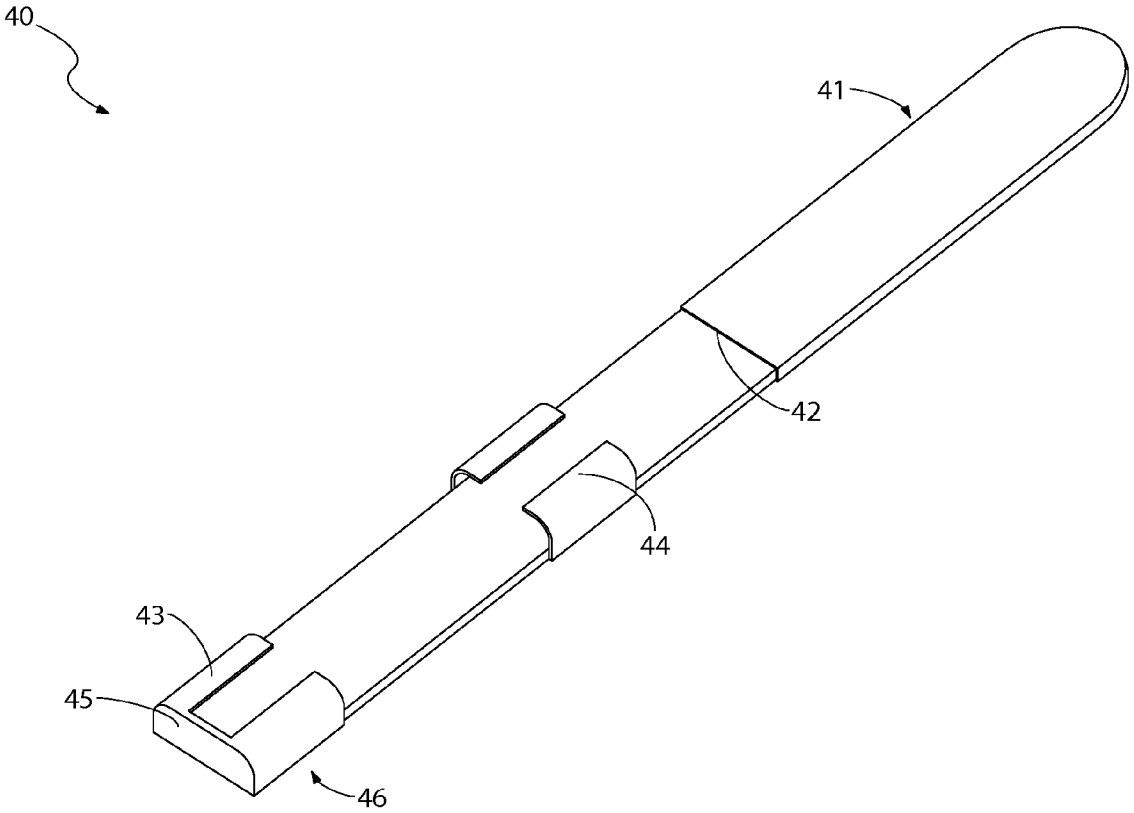
FIG. 7 is a perspective view of a cheater bar attachable to the offset wrench with adjustable head in accordance with the present invention; and, FIG. 8 is side view of the offset wrench with adjustable head with the cheater bar attached.
Figure 8:
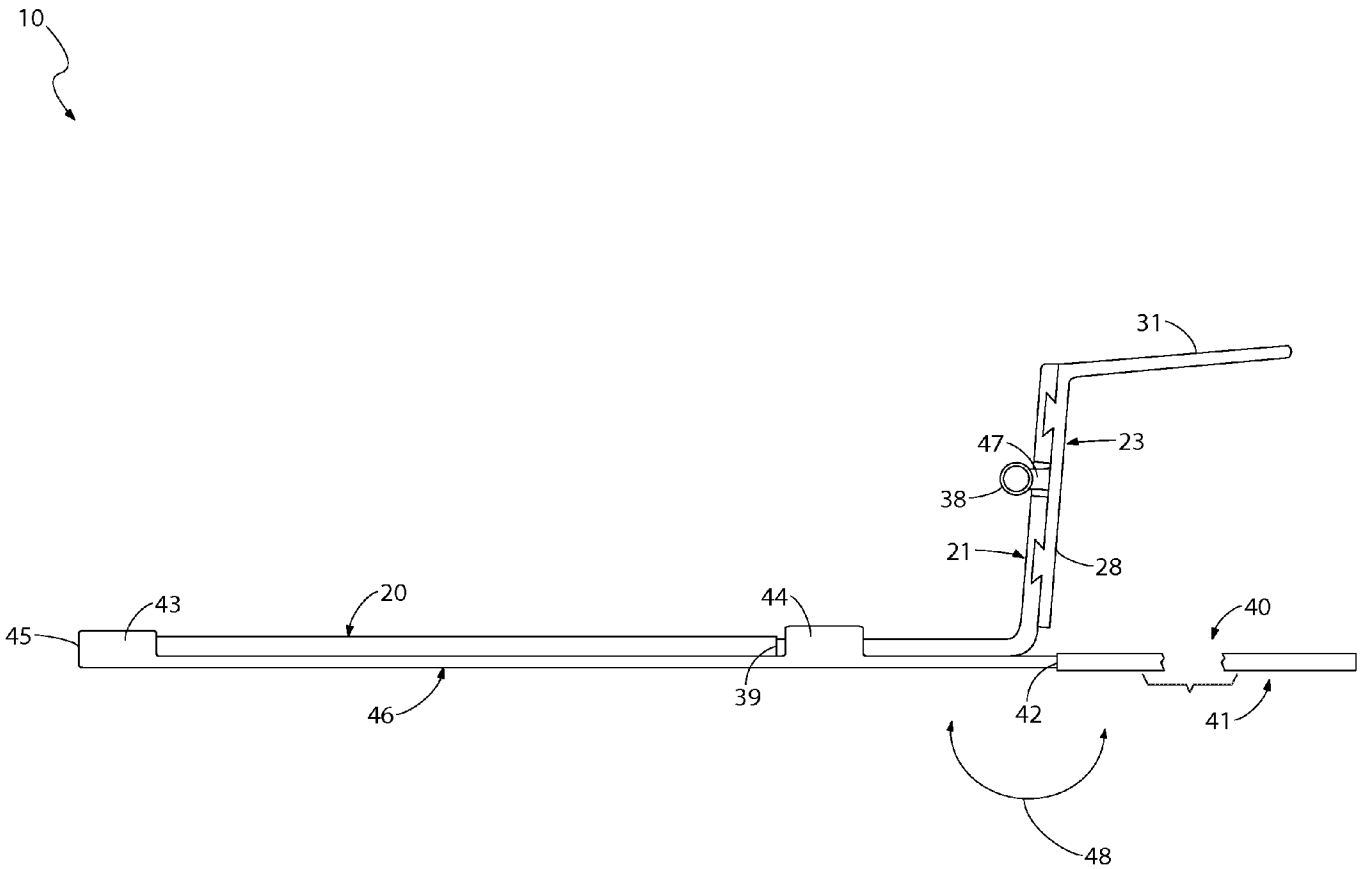

In accordance with the invention, the best mode is presented in terms of a preferred embodiment, herein depicted within FIGS. 1 through 5, and in terms of alternate embodiments, herein depicted within FIGS. 6 through 8. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 8, depicting an offset wrench with adjustable head (herein described as a "device") 10, where like reference numerals represent similar or like parts. In accordance with the invention, the present disclosure describes an adjustable device 10 for removing and installing fire sprinkler heads from fire sprinkler systems.

Figure 3:
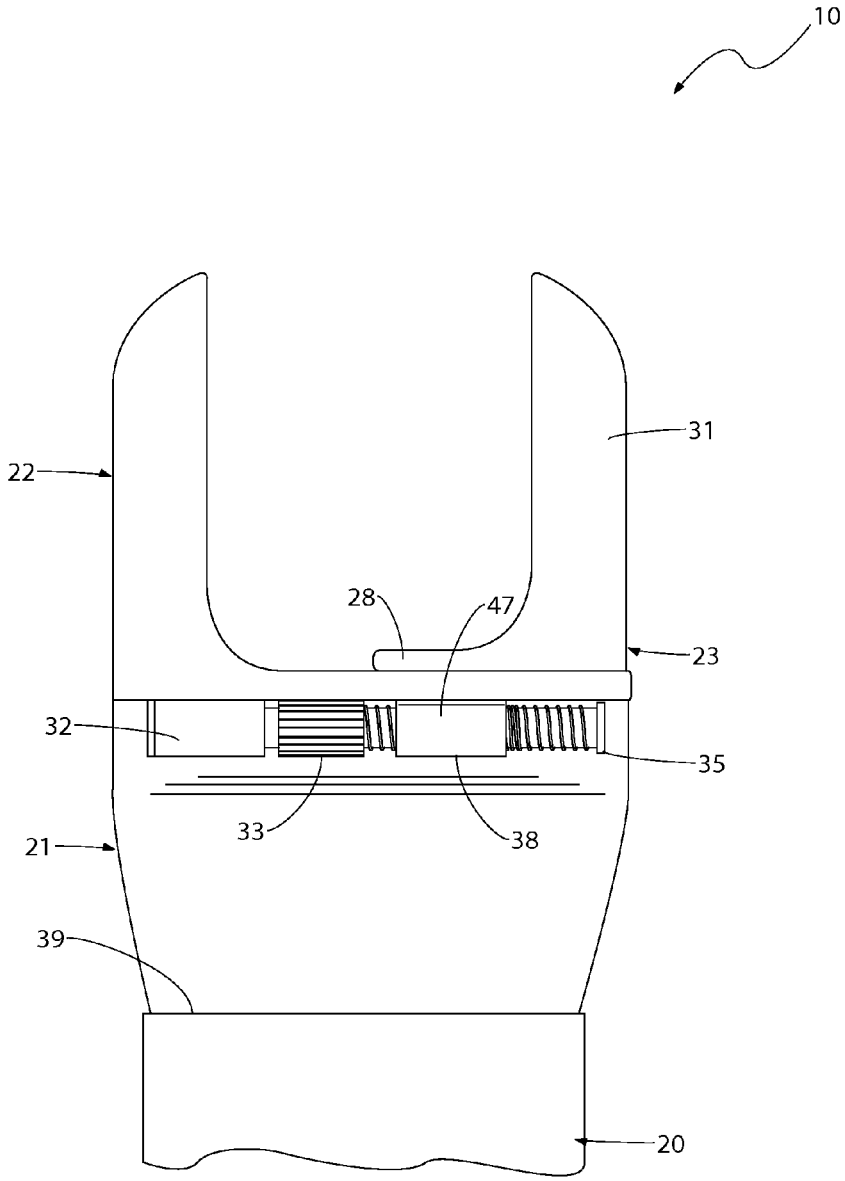
FIG. 3 is a top view of the offset wrench with adjustable head.

Referring to FIGS. 1 through 5, the device 10 is provided with a double offset embodiment generally including an elongated handle 20, a shank 21, a fixed jaw 22, and an adjustable jaw 23. The device 10 is preferably fabricated from cast aluminum, cast iron, or similarly durable and rigid materials. The handle 20 has a generally flat shape from a grip end and to the shank 21. The handle 20 is approximately six inches (6 in.) long, one inch (1 in.) wide and between one quarter inch (¼ in.) and five-sixteenths inch (5⁄16 in.) thick; however it can be appreciated that these general dimensions can vary depending upon final manufacture and design. In certain embodiment a handle 20 also includes a rubberized handle cover 39 integrally affixed to an exterior surface. The shank 21 is preferably flat. The handle 20 and the shank 21 preferably have rounded and tapered sides to provide a comfortable grip to a user. The shank 21 extends from the handle at a first offset angle 24, defined between a back surface of the shank 21 and a top surface of the handle 20. As best seen in FIG. 5, this first offset angle 24 is preferably between ninety degrees (90°) and one hundred degrees (100°), preferably ninety-five degrees (95°). The shank 21 has a generally flat front and back surface and a thickness of approximately between one-fourth inch (¼ in.) and five-sixteenths inch (5⁄16 in.).

The fixed jaw 22 is disposed at an upper side shoulder of the shank 21 and extends from an end of the shank 21 opposite the handle 20 at a second offset angle 26. The second offset angle 26 is defined between a lower surface of the jaw 22 and the front surface of the shank 21. As best seen in FIG. 5, this second offset angle 26 is approximately between ninety degrees (90°) and one hundred degrees (100°), preferably ninety-five degrees) (95°. The offset angles 24, 26 allow the jaws 22, 23 to access and engage recessed or concealed sprinkler heads. The adjustable jaw 23 is movably attached to the shank 21. An adjustment mechanism 27 is attached to the shank 21 and mechanically connected to the adjustable jaw 23 for slidably adjusting the position of the adjustable jaw 23 relative to the fixed jaw 22, thereby adjusting the width between the jaws 22, 23.

Figure 2:
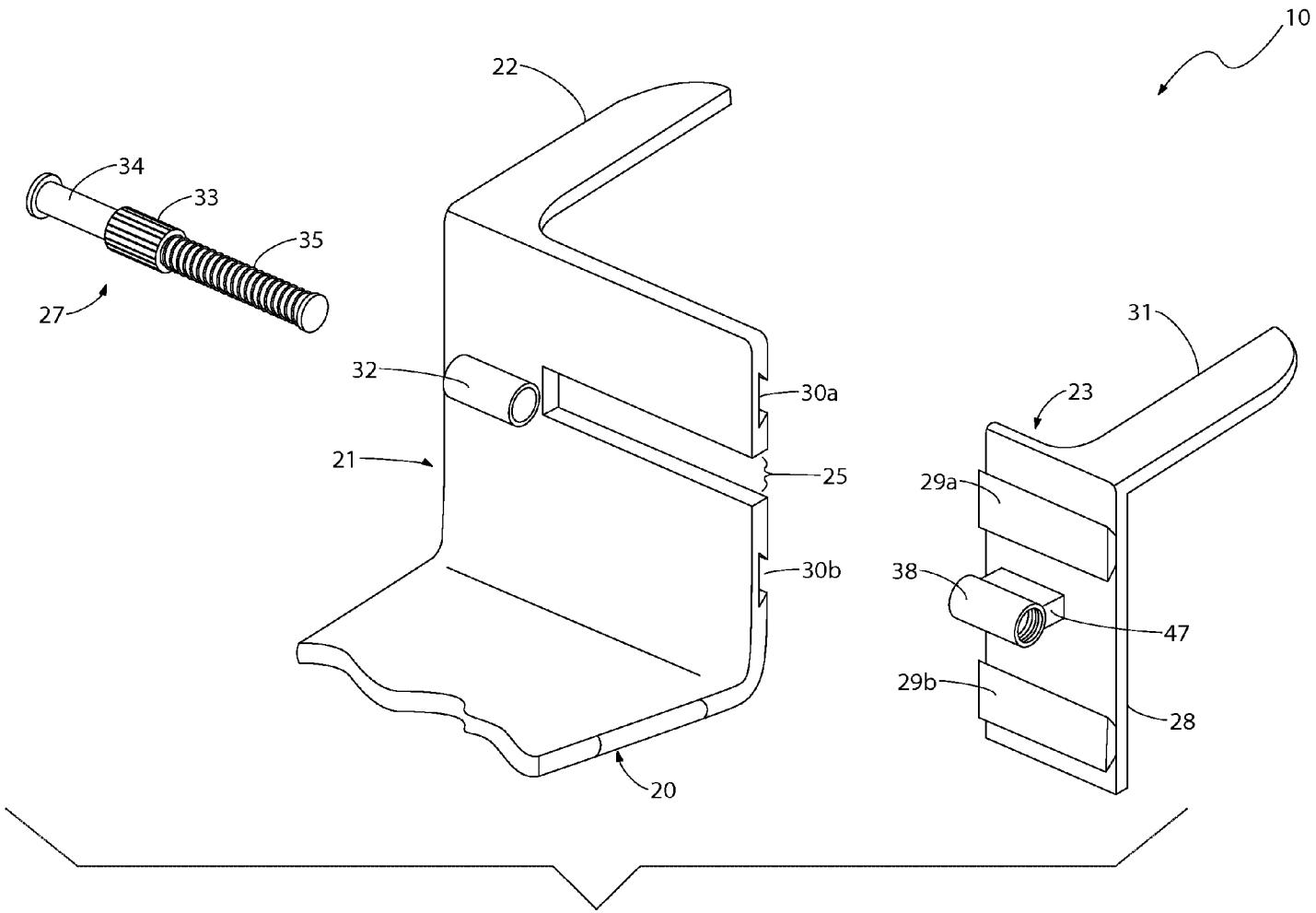
FIG. 2 is an exploded partial rear perspective view of the offset wrench with adjustable head.

As best seen in FIG. 2, the adjustable jaw 23 includes a base member 28 and a jaw member 31. The base member 28 is a generally flat rectangular member in contact with the front surface of the shank 21. The back surface of the base member 28 contacts the front surface of the shank 21. The jaw member 31 extends from the base member 28 at the second offset angle 26, such that the fixed jaw 22 and the adjustable jaw member 31 are parallel and aligned. The fixed jaw 22 and the adjustable jaw member 31 are approximately between one and five-eighths inch (1⅝") and one and three-fourths inch (1¾ in.) long and seven-sixteenths inch (7⁄16 in.) and five-eighths inch (⅝ in.) wide. These dimension ranges provide for standard and large embodiments of the device 10. The outside edges of the fixed jaw 22 and the adjustable jaw member 31, particularly approaching the end, are rounded to accommodate fitting into obstructed areas when engaging a concealed sprinkler head.

As best seen in FIG. 2, the adjustment mechanism 27 includes an actuator wheel 33, a smooth shaft 34 extending from a first side of the wheel 33, and a threaded shaft 35 extending from the opposing second side of the wheel 33. A smooth collar 32 is affixed to the back surface of the shank 21 for connection of the smooth shaft 34. The smooth collar 32 is a tubular member having a smooth interior surface for allowing the smooth shaft 34 to freely rotate therewithin. An end of the smooth shaft 34 opposite the wheel 33 has a diameter larger than the inner diameter of the smooth collar 32 which acts as a stop and retains the smooth shaft 34 within the smooth collar 32. A threaded collar 38 is affixed to the back surface of the base member 28 between a pair of keeper features 29. The threaded collar 38 is a tubular member having a threaded interior surface for mechanically engaging the threaded shaft 35, such that rotation of the adjusting mechanism 27 moves the adjustable jaw 23 inwardly and outwardly relative to the fixed jaw 22. An end of the threaded shaft 35 opposite the wheel 33 has a diameter larger than the inner diameter of the threaded collar 38 which acts as a stop to prevent the adjustable jaw 23 from moving off of the threaded shaft 35 due to over rotation.

As best seen in FIGS. 2 and 4, the shank 21 includes an adjustment recess 25 extending laterally inward from a side portion opposite the fixed jaw 22 to accommodate the threaded collar 38 during movement of the adjustable jaw 23. The pair of keeper features 29 extends generally perpendicularly outward and laterally along a back surface of the base member 28 opposite the jaw member 31. An upper keeper feature 29*a* is disposed on an upper end of the base member 28 and a lower keeper feature 29*b* is disposed on a lower end of the base member 28. A pair of keeper channels 30 extends laterally inward from the side portion opposite the fixed jaw 22. An upper keeper channel 30*a* is disposed above the adjustment recess 25 at an upper end of the shank 21. A lower keeper channel 30*b* is disposed below the adjustment recess 25 at a lower end of the shank 21. The keeper features 29 align with and slide within the keeper channels 30. The keeper features 29 have a generally triangular cross-sectional shape and the keeper channels 30 have a matching generally triangular cross-sectional profile and dimensions, within close tolerance of the keeper feature 29, such that the keeper features 30 are slidable and securely retained within the keeper channels 30. The keeper channels 30 extend through the shank 21*a* sufficient distance to allow the adjustable jaw 23 to close and approach the fixed jaw 22.

As best seen in FIG. 5, the threaded collar 38 extends away from the back surface of the base member 28 at a distance approximately equivalent to the thickness of the shank 21 by a standoff member 47. The adjustment recess 25 allows the threaded collar 38 to move linearly along the threaded shaft 35.

As best seen in FIGS. 3 and 5, the adjustment mechanism 27 extends laterally along the back of the shank 21 and mechanically connects the smooth collar 32 and the threaded collar 38. The wheel 33 is generally disposed at a center of the back surface of the shank 21 and is not in contact with nor is it connected to the shank 21 or the either of the collars 32, 38; thus allowing it to freely rotate. In certain embodiments, the adjustment recess 25 extends inwardly a sufficient distance such that the wheel 33 is positioned within the adjustment recess 25. This embodiment allows the wheel 33 to be larger by accommodating a larger diameter without interfering with the back surface of the shank 21. In certain embodiments, the wheel 33 also includes a knurled or textured surface for improving contact with the finger or thumb of the user during rotation of the wheel 33 and width adjustment of the adjustable jaw 23. Rotation of the wheel 33 in a first direction expands the adjustable jaw 23 outwardly to an expanded state by incrementally sliding the base member 28 out from the shank 21 and away from the fixed jaw 22. Rotation of the wheel 33 in an opposing second direction retracts the adjustable jaw 23 inwardly to a retracted state by incrementally sliding the base member 28 into the shank 21 and toward the fixed jaw 22. Preferably the distance between the jaws 22, 23 in the standard version of the device 10 is width-adjustable between approximately five-eighths inch (⅝ in.) in the retracted state and three-fourths inch (¾ in.) in the expanded state, in order to accommodate sprinkler heads of varying sizes. Preferably the distance between the jaws 22, 23 in the large version of the device 10 is width-adjustable between approximately three-fourths inch (¾ in.) in the retracted state and one and one-eighths inches (1⅛ in.) expanded state, in order to accommodate sprinkler heads of varying sizes.

Referring to FIG. 6, the device 10 can also be provided in a single offset embodiment generally including the elongated handle 20, the shank 21, the fixed jaw 22, and the adjustable jaw 23. The single offset embodiment of the device 10 includes substantially similar features as the previously described double offset embodiment. In the single offset embodiment of the device 10, the first offset angle 24 is approximately one hundred eighty degrees (180°) providing a generally straight handle 20 and shank 21. In the single offset embodiment of the device 10, the second offset angle 26 is approximately between one hundred forty-five degrees (145°) and one hundred sixty-five degrees (165°) between the shank 21 and the jaws 22, 23.

Referring to FIGS. 7 and 8, the device 10 can also include an attachable cheater bar 40. The cheater bar 40 is preferably fabricated from cast aluminum, cast iron, or similarly durable and rigid materials. The cheater bar 40 included an elongated generally flat bar handle end 41 and a generally flat retainer end 46. In certain embodiments the bar handle end 41 also includes a rubberized bar handle cover 42 integrally affixed to an exterior surface. A pair of handle retainers is affixed along the retainer end 46 for receiving and retaining the handle 20 of the device 10. An outer handle retainer 43 is affixed to an end of the retainer end 46 opposite the grip of the bar handle end 41 for retaining the grip end of the handle 20 of the device 10. An inner handle retainer 44 is affixed to the retainer end 46 at an intermediate position for retaining the end of the handle 20 of the device 10 near the shank 21. The handle retainers 43, 44 are generally C-clamp type members having an open inner area suitably shaped and sized for insertingly receiving the handle 20 of the device 10. The outer handle retainer 43 includes an open bottom and closed top surface 45 for inserting the handle 20 partially therethrough and stabilizing the handle 20 therewithin. The inner handle retainer 44 includes an open top and bottom for inserting the handle 20 entirely therethrough. As best seen in FIG. 8, the cheater bar 40 can be of any suitable length and is shown broken away to indicate indeterminate length for clarity. Preferably, the retainer end 46 of the cheater bar 40 has a length approximately equivalent to the length of the handle 20 of the device 10. The cheater bar 40 also includes a third offset angle 48 defined between bottom surfaces of the bar handle end 41 and the retainer end 46. The third offset angle 48 can be approximately one hundred eighty degrees (180°) providing a generally straight cheater bar 40. In certain embodiments, the third offset angle 48 can be less than one hundred eighty degrees (180°) providing a generally offset cheater bar 40.

It can be appreciated by one skilled in the art that other styles and configurations of the present invention can be easily incorporated into the teachings of the present disclosure and only certain particular configurations have been shown and described for purposes of clarity and disclosure and not by way of limitation of scope.

In accordance with the principles of the present invention, the various embodiments can be utilized by the user in a simple and effortless manner with little or no training. After initial purchase or acquisition of the device 10, it is installed and utilized as indicated in FIGS. 1 through 8. The method of utilizing the device 10 can be achieved by performing a series of steps. It can be appreciated that the steps described can be performed in alternative order and as such should not be viewed as a limiting factor.

To use the device 10, the user grips the handle 20 and positions the head, including the jaws 22, 23 next to a particular work surface. The device 10 is intended to be particularly beneficial for use when removing or installing recessed or concealed sprinkler head mechanisms of overhead fire sprinkler systems. The jaws 22, 23 are adjusted to a selected width-adjusted position by actuating the wheel 33 in a forward or rearward direction. Rotation of the wheel 33 in one (1) direction expands the adjustable jaw 23 outwardly for larger sizes of sprinkler heads. Rotation of the wheel 33 in the opposite direction retracts the adjustable jaw 23 inwardly for smaller sizes of sprinkler heads. The combined offsets of the first offset angle 24 and the second offset angle 26 provide for use of the device 10 around interfering structural features and allows the jaws 22, 23 to easily access the base of the sprinkler head. When removing or installing difficult or hard to turn sprinkler heads, the cheater bar 40 can be coupled to the handle 20 for providing additional torque and stability control.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

The invention claimed is:

1. An offset wrench with adjustable head comprising:
- a handle having a grip;
- a shank extending from said handle opposite said grip at a first offset angle relative to said handle;
- a fixed jaw extending from said shank at a second offset angle relative to said shank;
- an adjustable jaw moveably coupled to said shank at said second offset angle relative to said shank, comprising: generally flat base member; and,
  - a jaw member extending from said base member at said second offset angle relative to said base member;
- a smooth collar comprising a smooth interior wall affixed to said shank opposite said fixed jaw;
- a threaded collar comprising a threaded interior wall affixed to said base member opposite said jaw member; and,
- an adjustment mechanism mechanically connected between said smooth collar and said threaded collar for adjusting a distance between said fixed jaw and said adjustable jaw.

2. The device of claim 1, wherein said adjustment mechanism comprises:
- an actuator wheel;
- a smooth shaft extending from a first side of said wheel and insertably attached within said smooth collar; and,
- a threaded shaft extending from an opposing second side of said wheel and threadingly mated with said threaded collar;
- wherein rotation of said wheel adjusts said distance between said fixed jaw and said adjustable jaw.

3. The device of claim 2, wherein said first offset angle and said second offset angle are each approximately ninety-five degrees.

4. The device of claim 2, wherein said first offset angle is approximately one hundred eighty degrees.

5. The device of claim 4, wherein said second offset angle is approximately one hundred sixty degrees.

6. The device of claim 2, further comprising a cheater bar removably attachable to said handle comprising:
- an elongated bar having a handle end and a retainer end;
- an inner handle retainer disposed at an intermediate location of said bar for retaining an end of said handle at said shank; and,
- an outer handle retainer disposed on an end of said bar opposite said handle end for retaining said grip of said handle.

7. The device of claim 2, wherein said adjustable jaw comprises a pair of keeper features protruding outwardly from said rear surface of said base member; and,
- wherein said shank comprises a pair of keeper channels disposed laterally along a front surface for slidably receiving said keeper features.

8. An offset wrench with adjustable head comprising:
- a generally flat wrench handle comprising a grip end;
- a generally flat shank extending from said handle opposite said grip end at a first offset angle relative to said handle;
- a fixed jaw extending from said shank opposite said handle at a second offset angle relative to said shank;
- an adjustable jaw moveably coupled to said shank, said adjustable jaw comprising a generally flat base member and a jaw member extending from said base member at said second offset;
- a smooth collar comprising a tubular member having smooth interior wall affixed to a back surface of said shank opposite said fixed jaw; and,
- a threaded collar comprising a tubular member having threaded interior wall affixed to a back surface said base member opposite said jaw member;
- an adjustment recess disposed laterally through said shank to accommodate said threaded collar; and,
- an adjustment mechanism mechanically connected to said smooth collar and said threaded collar for adjusting a distance between said fixed jaw and said adjustable jaw.

9. The device of claim 8, wherein said adjustment mechanism comprises:
- a freely rotatable actuator wheel disposed along a rear surface of said shank;
- a smooth shaft extending from a first side of said wheel and insertably attached within said smooth collar; and,
- a threaded shaft extending from an opposing second side of said wheel and threadingly mated with said threaded collar such that rotation of said wheel adjusts a distance between said fixed jaw and said adjustable jaw.

10. The device of claim 9, wherein said adjustable jaw comprises a standoff member disposed between said base member and said threaded collar to alignably position said threaded collar along a common central axis of said smooth collar;
- wherein said threaded collar protrudes through said adjustment recess.

11. The device of claim 10, wherein said adjustable jaw comprises a pair of keeper features protruding outwardly from said rear surface of said base member; and,
- wherein said shank comprises a pair of keeper channels disposed laterally along a front surface for slidably receiving said keeper features.

12. The device of claim 11, wherein said first offset angle and said second offset angle are each approximately ninety-five degrees.

13. The device of claim 12, wherein said handle comprises a rubberized handle cover at said grip end.

14. The device of claim 12, wherein said wheel is disposed within said adjustment recess.

15. The device of claim 12, further comprising a cheater bar removably attachable to said handle comprising:
- a generally flat elongated bar having a handle end and a retainer end;
- a rubberized bar handle cover disposed on said handle end of said bar;
- an inner handle retainer disposed at an intermediate location of said bar for retaining an grip end of said handle at said shank; and, an outer handle retainer disposed on an end of said bar opposite said handle end for retaining said grip end of said handle.

16. The device of claim 15, wherein said handle end and said retainer end of said bar are at a third offset angle.

17. The device of claim 12, wherein said first offset angle is approximately one hundred eighty degrees.

18. The device of claim 17, wherein said second offset angle is approximately one hundred sixty degrees.

* * * * *